United States Patent [19]

Staats et al.

[11] 4,209,949

[45] Jul. 1, 1980

[54] METHOD AND APPARATUS FOR HIGH PRECISION LAPPING MACHINES

[75] Inventors: Clyde Staats, Irwin; John J. Pilewski, Greensburg, both of Pa.

[73] Assignee: Staats & Staats, Inc., Irwin, Pa.

[21] Appl. No.: 866,850

[22] Filed: Jan. 4, 1978

[51] Int. Cl.[2] ..... B24B 37/02

[52] U.S. Cl. ..... 51/151; 51/165.9; 51/165.93

[58] Field of Search ..... 51/34 J, 59 R, 151, 51/152, 157, 165.9, 165.93, 263, 34 D

[56] References Cited

U.S. PATENT DOCUMENTS

| | | | |
|---|---|---|---|
| 1,562,587 | 11/1925 | Ranagan | 51/263 X |
| 2,128,751 | 8/1938 | Krohn | 51/34 J |
| 2,787,090 | 4/1957 | Peterson | 51/59 R X |
| 3,487,582 | 1/1970 | Hatukano | 51/59 R X |
| 3,557,494 | 1/1971 | Bullen | 51/263 X |
| 3,672,101 | 6/1972 | Grosseau | 51/165.93 |
| 3,702,043 | 11/1972 | Welbourn | 51/165.93 X |
| 3,848,365 | 11/1974 | Bovensiepen | 51/165.9 X |
| 3,903,653 | 9/1975 | Imhoff | 51/59 R |

*Primary Examiner*—Gary L. Smith
*Attorney, Agent, or Firm*—Jon M. Lewis

[57] ABSTRACT

A method and apparatus is disclosed for high precision lapping. This high precision is accomplished by the lapping stroke between the lap and the workpiece always having a substantially constant predetermined stroke in one direction and an approximately constant predetermined stroke in the other direction. The approximately constant stroke is accomplished by sensing the contact force between the lap and the workpiece and stopping an engaging stroke therebetween when a predetermined contact force is reached and then starting a constant disengaging stroke. When the substantially constant predetermined disengaging stroke is completed, the engaging stroke begins.

10 Claims, 10 Drawing Figures

METHOD AND APPARATUS FOR HIGH PRECISION LAPPING MACHINES

BACKGROUND OF INVENTION

1. Field of Invention

The present invention relates generally to lapping machines and more particularly to high precision lapping machines.

2. Description of the Prior Art

Lapping machines are well known in the prior art and include such examles as Roos light and heavy duty lapping machines which have circular lapping motions and manual feeds of the lapping stroke. These Roos lapping machines are available from Carboloy, a division of General Electric. Also available from Carboloy are reciprocating head lapping machines which have reciprocating feed motions and spring tension feed. Deformation of the lap, inaccurate tension feed and unpredictable abrasive feed are problems found in prior art lapping machines.

SUMMARY OF INVENTION

The present invention provides for sensing the pressure or force between the lap and a workpiece during an engaging stroke. When the pressure between the lap and the workpiece reaches a predetermined level the engaging stroke stops. The pressure level at which the engaging stroke is stopped is determined by a desirable maximum pressure exerted between the lap and the workpiece. This pressure is chosen so that the lap will not deform, and that no damage to the surface of the workpiece will result. Thereby, the very highest precision work product is produced. The lap and the workpiece are then disengaged such as to diminish the pressure between. This disengaging stroke has a constant amplitude which allows for a very accurate subsequent engaging stroke which is repeatable and highly precise thereby imparting a highly precise and repeatable finish and final dimensions to the workpiece. The subsequent engaging stroke is therefore substantially equal to the accurately measured disengaging stroke. By determining such an accurate engaging stroke (which is stopped when the pressure between the lap and the workpiece reaches a predetermined level) an extremely accurate work product is produced. In addition, the approximately constant engaging stroke meters a substantially constant quantity of abrasive between the workpiece and the lap thereby insuring a very accurate, precise and repeatable lapping phenomenon from one stroke to the next and from one workpiece to the next in a production series.

DESCRIPTION OF THE PREFERRED EMBODIMENT

Figure 1:
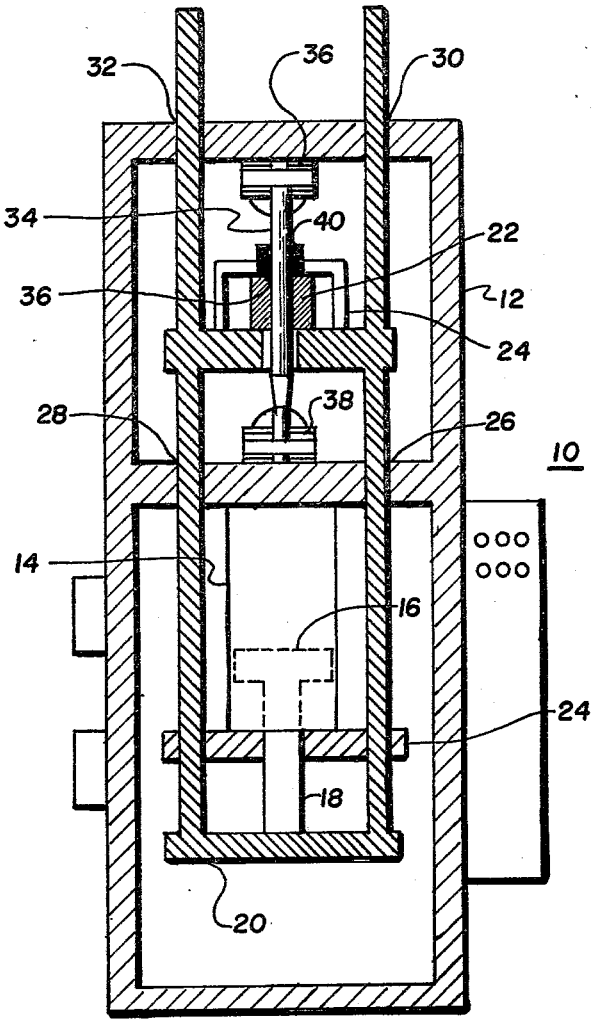
FIG. 1 shows a front view of a lapping machine according to the invention.

Referring to FIG. 1, a lapping machine 10 is shown, having a frame 12 and a pneumatic cylinder 14 connected thereto. The cylinder 14 has a piston 16 therein with a shaft 18 connected thereto protruding from one end thereof. The shaft 18 is capable of moving a guidance assembly 20 which holds a workpiece 22 thereon by means of a clamp 24. The guidance assembly 20 is guided by bearings (not shown) in a bearing carrier 25 which in turn is attached to the cylinder 14. The guidance assembly 20 is also guided through the frame at openings 26, 28, 30 and 32. A lap 34 is shown extending through an orifice 36 in the workpiece 22. The lap 34 is stiffened at both the ends thereof by alignment locks **32*a* and 38. These alignment locks 36*a* and 38 stiffen the operation of the lap 34 by holding it rigidly in the frame 12 so that the lap 34 does not flex appreciably during operation as is common in the prior art. An abrasive vehicle cup 40 is disposed in contact with the workpiece 22 and concentrically arranged around the lap 34. During operation, the abrasive held in the abrasive vehicle cup 40 is drawn between the lap 34 and the workpiece 22 as the workpiece is moved up and down by the action of the piston 16 and its shaft 18 on the guidance assembly 20**.

The guidance assembly 20 moving the workpiece 22 allows for a stiffening of the lap 34 which is advantageous in the operation thereof. Another embodiment of the present invention would be to move the lap 34 up and down and keep the workpiece 22 stationary rather than vice versa.

Figure 2:
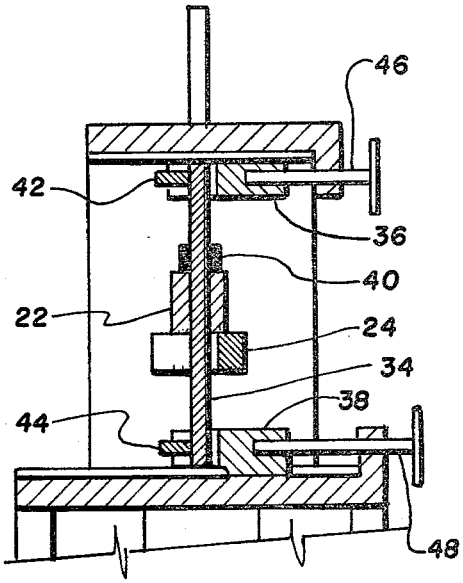
FIG. 2 shows a side view of a lapping machine according to the invention.

FIG. 2 shows a side view of a portion of FIG. 1 comprising the lap 34 and the alignment locks 36 and 38. The lap 34 is held in the adjustment alignment locks **36*a* and 38 which have straps 42 and 44. The alignment locks 36*a* and 38 have adjustments in the form of feed screws 46 and 48 connected through portions of the frame 12. The abrasive vehicle cup 40 is again shown in contact with the workpiece 22 which in turn is clamped, as shown in FIG. 1, to the guidance assembly 20**.

Figure 3:
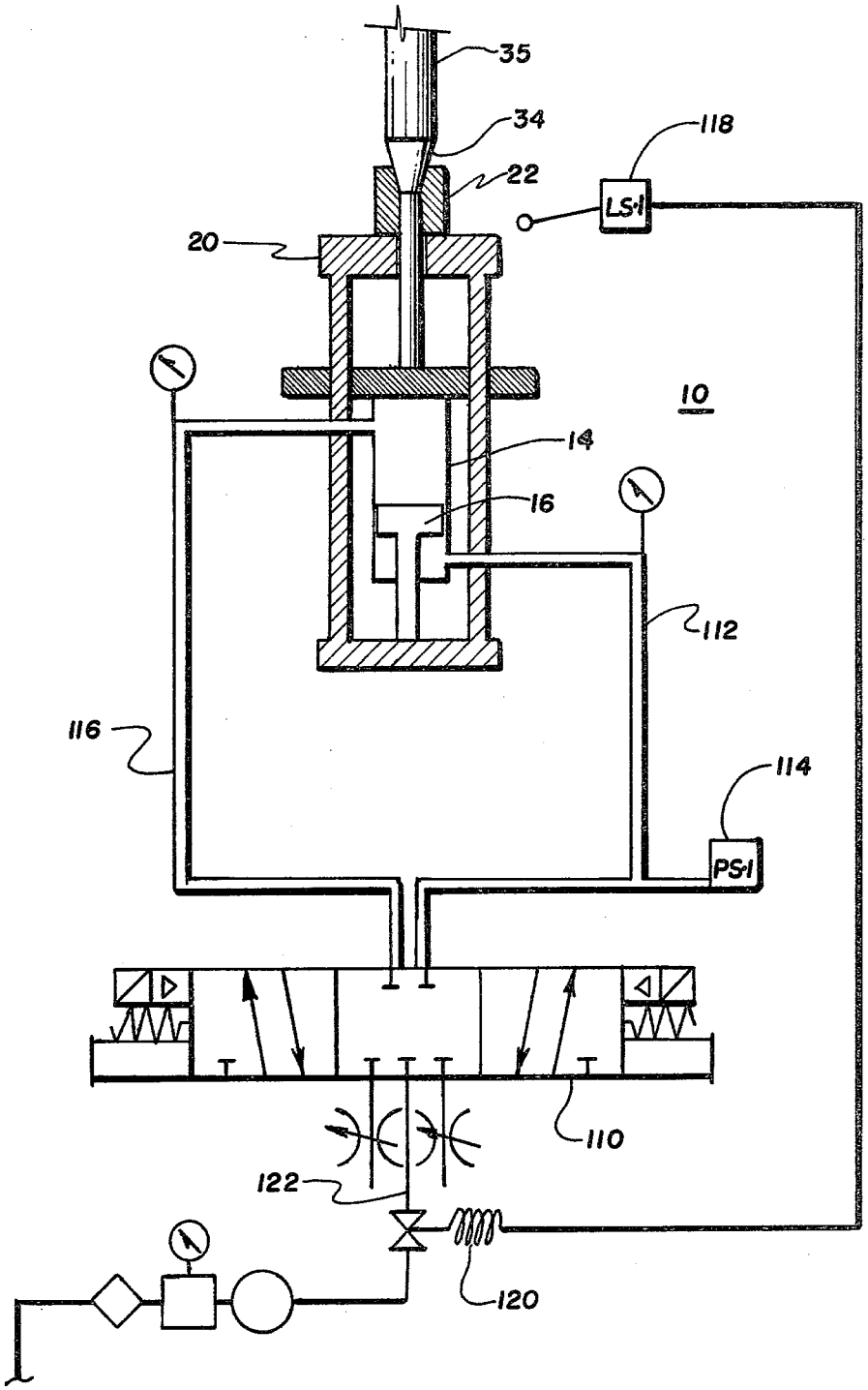
FIG. 3 shows a schematic diagram of the pneumatic controls.

FIG. 3 shows the electrical and pneumatic control for the lapping machine 10. A dual acting solenoid valve 110 controls the flow of pneumatic fluid to each end of the cylinder 14 for displacing the piston 16 in a reciprocating motion. Pneumatic lines 112 and 116 are connected from the valve 110 to the lower and upper ends of the cylinder 14, respectively. During the upward stroke of the workpiece 22 against the lap 34, a pressure in the pneumatic line 112 which forces the piston 16 up, is monitored by a pressure sensitive switch 114 adjusted to a predetermined pressure. When a predetermined pressure has built up in the line 112 and in the area below the piston 16 due to the interaction and the resistance to motion between the workpiece 22 and the lap 34, the pressure switch 114 is energized thereby causing the reversal of the position of the double acting solenoid valve 110 and forcing pneumatic fluid to flow through the pneumatic line 116 to the upper portion of the cylinder 14, thus applying a pressure to the upper part of the piston 16 whereby the workpiece is moved down in a disengaging manner from the lap 34. The piston 16 is then moved down a predetermined distance from the position when the pressure switch 114 was energized. The reciprocating motion of the workpiece 22 and the piston 16 continues until the orifice in the workpiece 22 is the same size as the upper portion 35 of the lap 34 whereupon the guidance assembly 20 makes contact with a limit switch 118 which stops the operation of the piston 16 by turning off the supply of pneumatic fluid to the solenoid valve 110 by closing another solenoid valve 120, connected to a pneumatic line 22, connected to and supplying the double acting solenoid valve 110, (or alternatively if the valve 110 is a two way three position valve by shifting the valve 110 to its center blocking position).

Figure 4:
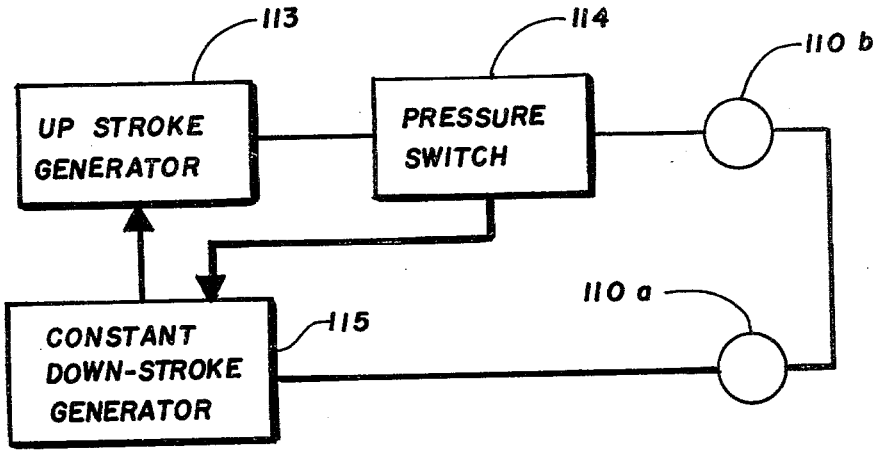
FIG. 4 shows a block diagram of the controls for the lapping machine.

FIG. 4 shows a block diagram of the operation of the lapping machine. An up stroke generator 113 moves the piston 16 upward by energizing the solenoid **110*b* which supplies air to the bottom of the piston 16 until the force between the workpiece 22 and the lap 34 restrict the movement of the piston 16 thereby building up pressure in the line 112, opening the pressure switch 114 and stopping the flow of air and the movement of the piston 16. The pressure switch 114 energizes the constant down stroke generator 115 which opens the solenoid 110*a* which admits air to the top of the piston 16 and forces the workpiece 22 downward in a substantially constant distance. When the constant down stroke is completed the constant down stroke generator 115 energizes the up stroke generator 113** starting a new up stroke.

BASIC OPERATION OF THE LAPPING MACHINE

Figure 5:
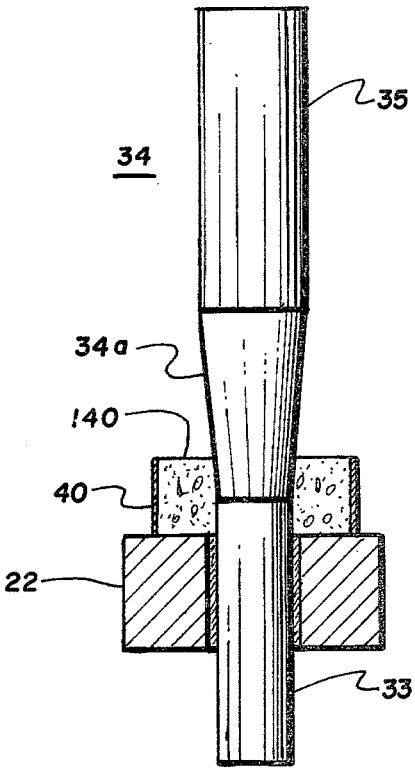
FIGS. 5 and 6 show detailed drawings of the lap in various positions with respect to the workpiece.
Figure 6:
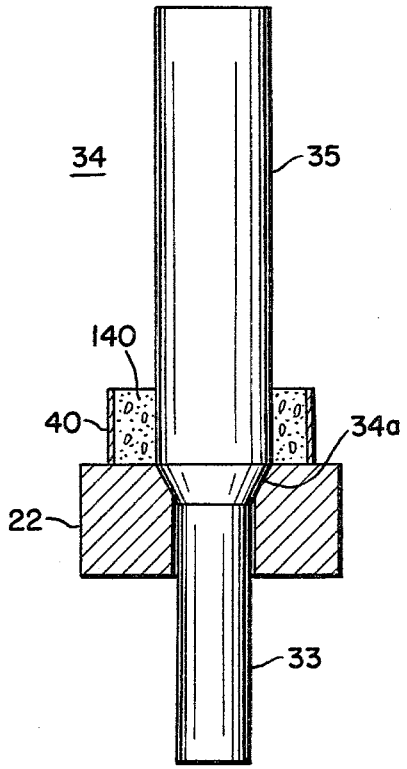

FIG. 5 shows the workpiece 22 before the lap makes contact therewith. The lap has three parts, a narrow section 33, a tapered section **34*a*, and a thick section 35. The workpiece 22 is raised until the tapered portion of the lap 34 comes into contact with the workpiece and builds up a predetermined pressure or force between the tapered portion of the lap 34 and the workpiece 22. As this predetermined force or pressure builds up between the workpiece 22 and the lap 34, this increase in force is sensed by the pressure switch 114, because of a corresponding increase in the pressure at the bottom of the piston 16. At this pressure sensed by the switch 114 the workpiece stops. The reversal of the solenoid valve 110, as shown in FIG. 3, reverses the flow of pneumatic fluid. The pneumatic fluid is then pumped through the pneumatic line 116 to the top of the piston 16 thereby lowering the workpiece 22 in a disengaging motion between the workpiece 22 and the lap 34. The workpiece is lowered a predetermined and constant amount in each disengaging motion as is shown in FIG. 5. The engaging motion is shown in FIG. 6**.

Then the workpiece is again raised, such that, an approximately constant down stroke is obtained before the force or pressure between the workpiece 22 and the lap 34 in the down stroke or engaging motion exceeds or is equal to the predetermined engaging force sensed by the pressure switch 114. This motion is then continued with each up stroke being a constant amplitude or displacement and each down stroke being approximately a constant amplitude.

The abrasive 140 in the abrasive vehicle cup 40 surrounding the lap 34 and making contact with the workpiece 22 feeds abrasive between the lap 34 and the workpiece 22. The amount of abrasive is essentially metered by the approximately constant down stroke, such that, a relatively constant amount of abrasive is always used in the engaging or up stroke of the workpiece 22 against the lap 34 whereby a very accurate and precise lapping operation is achieved and the lapped piece has a very precise and accurate and smooth lapped area.

When the workpiece 22 is in contact with the upper portion 35 of the lap 34 the orifice 122 is at its finished dimension and the workpiece 22 is in its finished position. In this position, the limit switch 118 is activated and the operation of the lapping machine 10 is stopped.

By supporting the lap 34 at both ends the stiffness of the lap 34 is increased very substantially and any flexing in contact between the workpiece 22 and the lap 34 is greatly decreased.

Since the operation of the constant stroke in the lapping machine provides for a metering of a relatively constant quantity of abrasive in the engaging stroke a dry abrasive rather than a slurry of abrasive liquid can be used which eliminates caking and also the need for a pump to move the slurry of abrasive and liquid.

Figure 8:
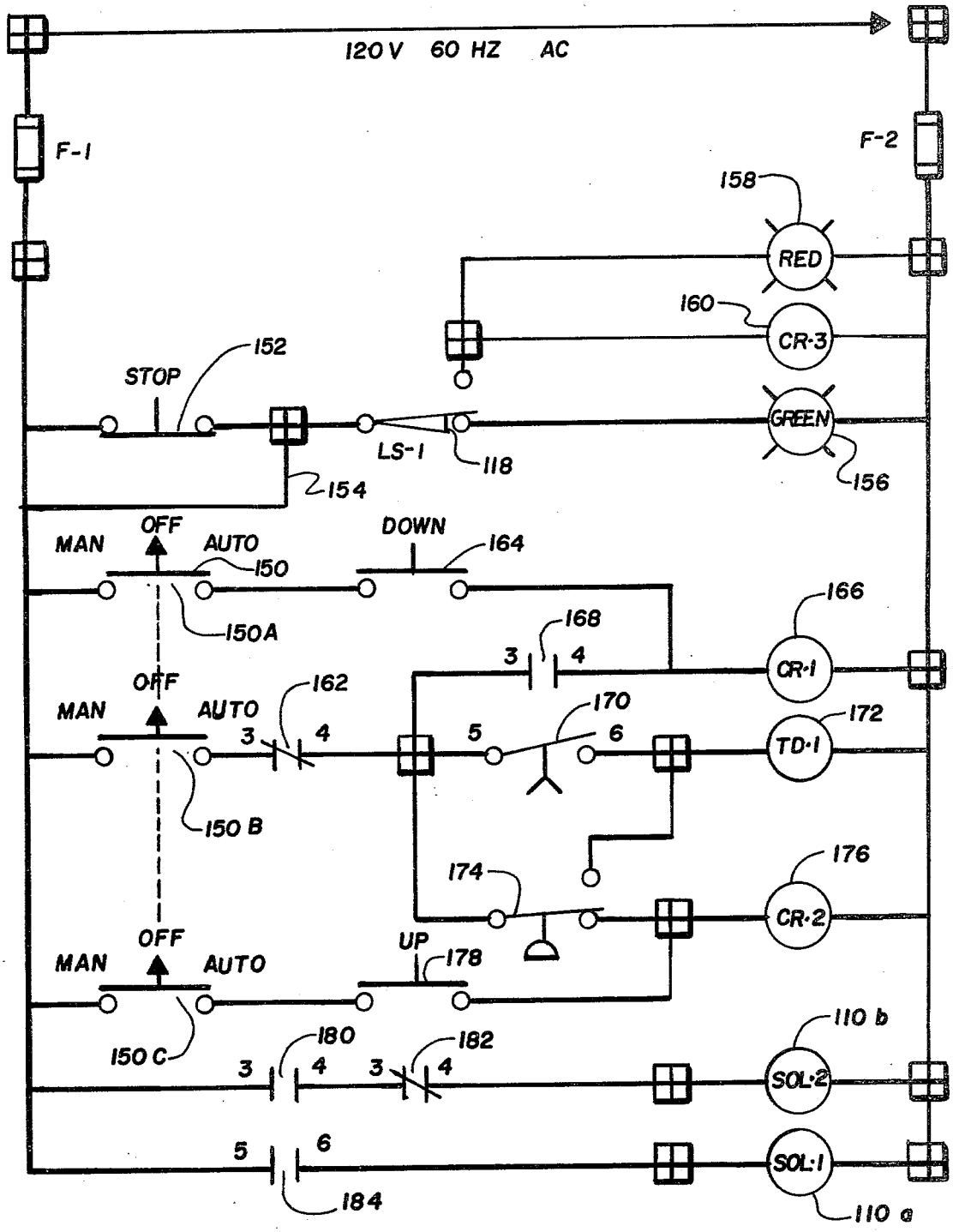
FIG. 8 is an electrical schematic diagram of one embodiment of the electrical controls for the lapping machine.

Referring now to FIG. 8 which shows the electrical controlled equipment for operating the solenoid 110 of FIG. 3. AC or DC voltage may be used to power the control circuit of FIG. 8. However, it is preferred that 120 volts 60 cycle AC is used. A selector switch 150 has three sections, **150*a*, 150*b* and 150*c*. These sections are all connected to power from a stop switch 152 which controls the application of the typically 120 volt AC power through the selector switch 150 with its three sections 150*a*, 150*b* and 150*c*. One terminal of each of the sections, 150*a* 150*b* and 150*c*, of the selector switch 150 are connected to a conductor 154 which runs between the stop switch 152. The stop switch 152 is also connected to one side of the limit switch 118. The side of the limit switch 118 not connected to the stop switch 152 has two positions, one which assumes a normally closed position when the lapping operation on the workpiece 22 has not been completed and which connects to a green light 156. The side of the green light not connected to the limit switch 118 is connected to the side of the 120 volt AC power source opposite the stop switch 152. In the other, normally open position of the limit switch 118, the power from the stop switch 152 is fed to a red light 158 which when lit indicates that the lapping operation has been completed. The side of the red light 158 not connectable to the switch 118 is also connected to the side of the power supply which is opposite to the side to which the stop button 152 connects. Also connected across the red light 158 is a relay coil 160. Relay contacts 162 energized by the relay coil 160 are connected to the side of the contact on the side of the selector switch contact 150*b* which is not connected to the stop switch 150**.

A down button 164 is connected in series with the side of the contact **150*a* which is not connected to the stop button 152. The contact of the down button 164 not connected to the contact of 150*a* is connected to one side of a relay coil 166 and also to one side of relay contacts 168. The side of relay contacts 168 not connected to the down switch 164 are connected to the side of the relay contacts 168 which are not connected to the contacts 150*b*. The relay contacts 168 are also connected to one side of one set of contacts of 170 associated with a relay coil 172. The common point between the relay contacts 168 and 170 is connected to one side of the contacts 174 of the pressure switch 114. The contacts 174 of the pressure switch 114 are normally closed and in that position make contact with the coil of a relay 176. The normally open contact of the contacts 174 of the pressure switch 114 is connected to the junction of one of the contacts 170 and the relay coil 172. The junction of the normally closed contact of the contact 174 and the coil of the relay 176 is connected to one contact of an up push button 178, the other side of which is connected to the side of the contacts 150c which is not connected to the junction of the sections 150a and 150b. To the junction of the contacts of the sections 150a and 150b, a set of contacts 180 controlled by the relay coil 176 is connected in series with a set of contacts 182 of the relay coil 166 which combination is connected in series with solenoid 110b. The side of the solenoid 110b, not connected to the contacts 182, is connected to the junction of the relay coil 176 and the relay coil 172. The junction of the contacts 150c and the contacts 180 is connected to the series combination of a set of contacts 184 of the relay coil 166 and the solenoid 110a**.

DETAILED OPERATION OF THE PREFERRED EMBODIMENT

The piston 116 and the guidance assembly 20 are lowered by pumping a pneumatic fluid such as air through the pneumatic line 116 to the top of the piston 116. Contacts of a stop button 152 are originally open. The stop button 152 operates such that it is pulled to close and pushed to open. The limit switch 118 which is normally closed when the workpiece 22 is down, energizes the green light 156 indicating that the machine will operate. The selector switch 150 with its three sets of contacts, the sections 150a, 150b and 150c, is manipulated such that all the contacts are open. The pressure switch 114 is adjusted such that it will open when a preset pressure is built up under the piston 16. The relay coil 172 comprises part of a time delay relay which operates when energized by the contacts 168 and 174. The coil of the relay 172 closes contacts 170 which reopen after a predetermined preset time period. Initially, the down button 164 is depressed in order to lower the guidance assembly 20 with the workpiece 122 thereon. The up button 178 is depressed in order to raise the guidance assembly 20 and the workpiece 22 thereon. The solenoid valve 110 is designed such that when the solenoid coils 110a and 110b are de-energized its three position, four way direction control valve is spring loaded such that no air flows therethrough. Before starting a manually operated valve connected in the line supplying pneumatic fluid to the solenoid valve 110 is closed in order to insure that the lapping machine is not moved from its starting position inadvertantly.

Before the automatic operation begins, an operator sets the limit switch 118 at a maximum height which corresponds to the workpiece 22 having its lapping operation completed. The stop button 152 is pulled out thereby closing the contacts thereof which turn on the green light 156 by completing a circuit through the limit switch 118. The manual air valve is turned on thereby readying the lapping machine for automatic operation. A pressure regulator, not shown, is adjusted to provide a pressure which will allow a constant down stroke of the workpiece 22 when the time delay relay 172 operates. The pressure switch 114 is adjusted in order to take into account the size of the lap 34 and the size of the orifice in the workpiece 22. A flow control valve, well known in the art, is adjusted to regulate the speed of the piston 16. Next, the selector switch 150 is switched to the manual position which closes the contacts of the sections 150a and 150c and leaves the contact of the section 150b open. The up button 178 is then pressed and held thereby energizing the relay coil 176 which closes the corresponding relay contact 180 which in turn energizes solenoid 110b. The control valve 110 then shifts and the cylinder is filled with pneumatic fluid in its lower section thereby raising the piston 16 and workpiece 22. The up button 178 is then released which opens the contact thereof and de-energizes the relay coil 176 thereby de-energizing the solenoid 110b by opening the contact 180. The control valve 110 then shifts to a center position locking the ports leading to the hydraulic lines 112 and 116 thereby holding the piston 16 and the workpiece at a predetermined position. Then, the down button 164 is depressed and held whereby the relay coil 166 is energized thereby closing the contacts 184 controlled by the relay coil 166. The closing of the relay contacts 184 energizes solenoid 110a thereby shifting the control valve 110 and allowing pneumatic fluid to pass through the hydraulic line 116 into the upper part of the cylinder 14 thereby forcing the piston 16 and the workpiece 22 to move downwardly. The down button 164 is then released opening the contacts thereof and de-energizing the relay coil 166 whereby the control valve 110 shifts to a center position locking the ports to the pneumatic lines 112 and 116 whereby the piston holds its position.

AUTOMATIC OPERATION OF THE PREFERRED EMBODIMENT

The selector switch 150 is turned to the automatic position whereby the contacts of the section 150b are closed and the contacts of the section 150a and 150c are open. Thereby, the relay coil 176 is energized, closing the corresponding relay contacts 180 and energizing the solenoid 110b. The control valve 110 shifts its position and opens the port to the pneumatic line 112 thereby permitting a pneumatic fluid to enter into the cylinder 14 and raising said piston 16 and the workpiece 22. The workpiece 22 continues to rise until it meets resistance in its contact with the lap 34 or more specifically the tapered portion thereof. As the workpiece 22 is pushed up against the lap 34 the pressure in the line 112 increases because the piston 16 does not move upward as readily as before. The pressure builds up in the line 112 and the volume below the piston 16 thereby activating the pressure switch 114 at the point when the predetermined pressure setting on the pressure switch 114 has been exceeded. At this predetermined pressure the contacts 174 of the pressure switch 114 open thereby de-energizing the coil of the relay 176 whereby the contacts 180 thereof open de-energizing the solenoid 110b. The control valve 110 therefore shifts to its center position blocking the flow of pneumatic fluid to the pneumatic lines 112 and 114. As the relay contacts 174 move upward to the normally open position, the time delay relay coil 172 is energized, thereby closing the contacts 117 thereof. The relay coil 166 is thereby energized whereby the relay contacts 182 thereof are opened. By the closing of the contacts 168 of the time delay relay 172, the coil of the relay 166 is energized and the contacts 184 closed, whereby solenoid 110a is energized. The control valve 110 then shifts and the cylinder 14 is pressurized by the pneumatic line 116 thereby pushing the piston 16, and also the workpiece 22 downwardly. As the pressure decreases in line 112 the contacts 174 of the pressure switch 114 move into the normally closed position thereby energizing the relay coil 176. However, the open contacts 182 prevent the solenoid 110*b* from being energized. The workpiece moves down for a preset time interval and distance predetermined by the time delay relay 172. The contacts 170 of the relay 172 open. The contacts 168 also open thereby de-energizing the relay coil 166 whereby the contacts 184 and 182 open and close, respectively. The closing of the contacts 184 energizes the solenoid 110*b* and the opening of the contacts 184 de-energizes the solenoid 110*b*. The piston 16 has now moved downward for a predetermined time period which corresponds substantially to a predetermined substantially constant down stroke. The cycle now repeats itself with the energization of the solenoid 110*b* which raises the workpiece 22 into renewed contact with the lap 34. The reciprocating cycle of the workpiece 22 continues until the workpiece 22 reaches its maximum height position. Whereupon, the limit switch 118 is activated thereby turning off the green light 156 and turning on the red light 154 and also energizing the coil of relay 160 thereby opening the contacts 162 thereof and stopping the operation of the machine. In order to remove the workpiece, an operator turns the selector switch to manual and presses the down button 164 and holds it until the machine reaches its desired downward movement position thereby permitting the workpiece to be removed.

Figure 9:
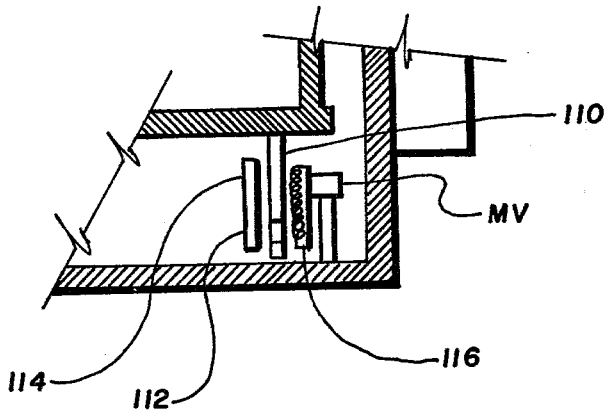
FIG. 9 is an embodiment having a linear transducer incorporated therein.

Referring now to FIG. 9, an alternative embodiment of the invention is shown having a linear transducer 210 connected to the guidance assembly 20. As the guidance assembly 20 moves downwardly, the linear transducer measures the travel thereof very accurately. The output of the transducer 110 provides a signal which begins the upstroke of the guidance assembly 20. One means by which this could be achieved is replacement of the time delay relay 172 by latching relay 172*a* with a de-energizing and an energizing coil which is de-energized by the output of the linear transducer 110.

Figure 10:
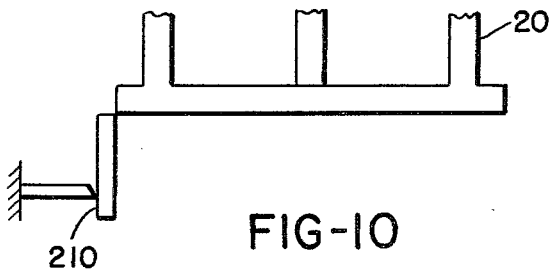
FIG. 10 shows the embodiment of FIG. 9 having an optical grating as a linear transducer.

Referring now to FIG. 10, the linear transducer is shown as a grating 12 having a predetermined spacing between measuring lines 214. Conncted thereto is an infra-red sensor and source of infra-red light such as light emitting diodes 216 and 218 respectively. The output of the transducer 216 is connected to an updown counter 220 which is reset by a signal from the relay 176. The output 222 from the counter 220 de-energizes the relay 172. The relay 172 typically has two sets of coils, one for energizing and one for de-energizing. The de-energizing coils are connected to the output 222 of the counter 220. Updown counters are well known in the art and are manufactured by Texas Instruments, Philbrick Industries, Burroughs, Inc., etc.

As it may readily appear to those skilled in the art, various changes may be made in relative locations and arrangements of the several parts without departing from the sphere and scope of this invention. It is not meant to limit the invention except by the following Claims:

We claim:

1. A lapping machine comprising:

a frame having motive means attached thereto, said motive means having a pneumatic cylinder for accepting a gas under pressure;

means connected to said motive means for providing relative motion between a lap and a workpiece by imparting a motion to said lap corresponding to motion of said pneumatic cylinder;

means for sensing a pneumatic pressure representative of a pneumatic pressure in said pneumatic cylinder, so that said sensed penumatic pressure has a correspondence to a predetermined force between said lap and said workpiece;

said sensing means including means for stopping said motive means upon the sensing of a predetermined pressure at a position corresponding to said predetermined force between said lap and said workpiece;

first means for energizing said motive means connected thereto provide a relative disengaging motion between said lap and sais workpiece, said disengaging motion have a substantially constant predetermined amplitude from said position of said predetermined pneumatic pressure corresponding to a predetermined force between said lap and said workpiece; and second means for energizing said motive means toward an engaging position between said lap and said workpiece.

2. The lapping machine of claim 1 including means for stiffening said lap at both ends thereof.

3. The lapping machine of claim 2 wherein said stiffening means includes means for guiding said motion between said lap and said workpiece perpendicular to a main surface of said workpiece.

4. The lapping machine of claim 3 including means for feeding an abrasive between said lap and said workpiece.

5. The lapping machine of claim 4 wherein said abrasive feeding means comprises a holder for surrounding said lap and for making contact with an upper surface of said workpiece.

6. The lapping machine of claim 5 wherein said first means and said second means provide approximately constant engaging strokes for metering a substantially uniform amount of abrasive between said lap and said workpiece whereby a high precision lapped workpiece is obtained.

7. The lapping machine of claim 6 wherein said abrasive feeding means comprises means for feeding a dry abrasive.

8. The lapping machine of claim 7 including means for limiting said relative motion by turning off said motor means when the lapping operation is completed.

9. The lapping machine of claim 8 wherein said limiting means comprises a limit switch.

10. The lapping machine of claim 9 wherein said motor means is adapted for connection to said workpiece.

* * * * *